United States Patent [19]

Yamamoto et al.

[11] Patent Number: 4,685,814

[45] Date of Patent: Aug. 11, 1987

[54] APPARATUS FOR DOT-MATRIX PRINTING OF CHARACTERS MISSING FROM A TYPE CARRIER

[75] Inventors: Takemi Yamamoto; Yasuhiro Miki, both of Aichi, Japan

[73] Assignee: Brother Kogyo Kabushiki Kaisha, Aichi, Japan

[21] Appl. No.: 794,134

[22] Filed: Nov. 1, 1985

[30] Foreign Application Priority Data

Nov. 2, 1984 [JP] Japan ..... 59-166966[U]

[51] Int. Cl.[4] ..... B41J 3/58; B41J 1/30; B41J 3/12

[52] U.S. Cl. ..... 400/82; 400/124; 400/144.2

[58] Field of Search ..... 400/16, 17, 18, 82, 400/121, 124, 144.1, 144.2, 144.3, 174, 175, 65

[56] References Cited

U.S. PATENT DOCUMENTS

| | | | |
|---|---|---|---|
| 4,217,055 | 8/1980 | Moon | 400/144.2 |
| 4,353,653 | 10/1982 | Zimmerman | 400/124 |
| 4,386,862 | 6/1983 | Kittel et al. | 400/144.2 |
| 4,425,846 | 1/1984 | Sakmann | 400/175 |
| 4,527,918 | 7/1985 | Yamamoto et al. | 400/17 |
| 4,595,303 | 6/1986 | Kuzuya et al. | 400/82 |

FOREIGN PATENT DOCUMENTS

| | | | |
|---|---|---|---|
| 211476 | 12/1983 | Japan | 400/144.2 |

*Primary Examiner*—Edgar S. Burr
*Assistant Examiner*—David A. Wiecking
*Attorney, Agent, or Firm*—Finnegan, Henderson, Farabow, Garrett and Dunner

[57] ABSTRACT

A composite printing apparatus includes a character-based impact printer, a dot matrix printer, and a memory for storing a plurality of sets of pattern data corresponding to different fonts and other characteristics of print images. The impact printer includes a print element carrier having indicia identifying the font and other characteristics of the print elements on the carrier. A print carrier detector determines from the indicia the type of type elements on the carrier and generates signals for selecting from the memory a set of corresponding pattern data that is used to control the dot matrix printer to produce character images with print quality and characteristics matching those of the character images produced by the impact printer.

6 Claims, 4 Drawing Figures

APPARATUS FOR DOT-MATRIX PRINTING OF CHARACTERS MISSING FROM A TYPE CARRIER

FIELD OF THE INVENTION

The present invention relates generally to a composite printing apparatus. More specifically, the present invention relates to a composite printing apparatus comprising a first printing assembly for printing characters by striking the backs of type elements arranged on the surface of a type element carrier and a second printing assembly for printing characters in conformity with stored dot matrix printing patterns.

BACKGROUND OF THE INVENTION

In a printing apparatus of this type, type elements are normally arranged on the periphery of a print wheel or belt. The print wheel or belt is replaceable so that an optimum font combination may be employed depending on the language, type style, and printing pitch. By these means, characters in various languages, type styles and different printing pitches are readily printable without changing major components of the printing apparatus. Examples of such composite printers are disclosed in U.S. patent applications Ser. No. 671,617 now U.S. Pat. No. 4,595,303, and 765,213 filed Nov. 15, 1984 and Aug. 13, 1985.

In a printing apparatus of this type, however, the number of usable characters which can be provided on one print wheel or belt is extremely limited because of the size of the printing apparatus. The characters provided on the print wheel or the belt must be supplemented by additional character patterns that are read from a pattern memory and reproduced by a pattern printer, e.g., a wire printer.

Herteofore, however, there has been provided only one kind of printing pattern for each character. The joint use of both types of printing assemblies has failed to provide a printing apparatus that produces printing in a wide variety of fonts because the number of languages and type styles obtained from character printing based on printing patterns has been extremely limited.

OBJECTS AND SUMMARY OF THE INVENTION

An object of the present invention is a composite printing apparatus for producing high quality, uniform print images from two different types of printing assemblies capable of printing on the same line.

Another object of the present invention is a composite printing apparatus wherein the characteristics of print images produced by one print assembly are determined by the characteristics of print images produced by a second print assembly. A further object of the present invention is a high quality composite printing apparatus including a character impact printer and a dot matrix printer.

These and other objects are achieved by a composite printing apparatus comprising a first printing assembly including a type element carrier having type elements thereon adapted for forming character images by impact printing, the carrier having indicia thereon for identifying characteristics of the type elements, a second printer assembly adapted for producing dot matrix images of characters in accordance with character pattern signals, means for generating a print character signal from the indicia on the carrier, the print character signal for identifying the characteristics of the type elements, a pattern memory for storing a plurality of sets of character pattern signals, and means for accessing from the pattern memory in accordance with the print character signal a set of character pattern signals corresponding to the characteristics of the type elements such that the character images formd by the second printer assembly correspond in characteristics to the character images formed by impact printing by the first printing assembly.

BRIEF DESCRIPTION OF THE DRAWINGS

The manner in which the above objects and other objects, features, and advantages of the present invention are attained will become more apparent from the following detailed description when considered in view of the drawings, wherein.

DETAILED DESCRIPTION OF THE PREFERRED EMBODIMENT

Referring now to FIGS. 1 through 4, an embodiment of the present invention will be described.

Figure 1:
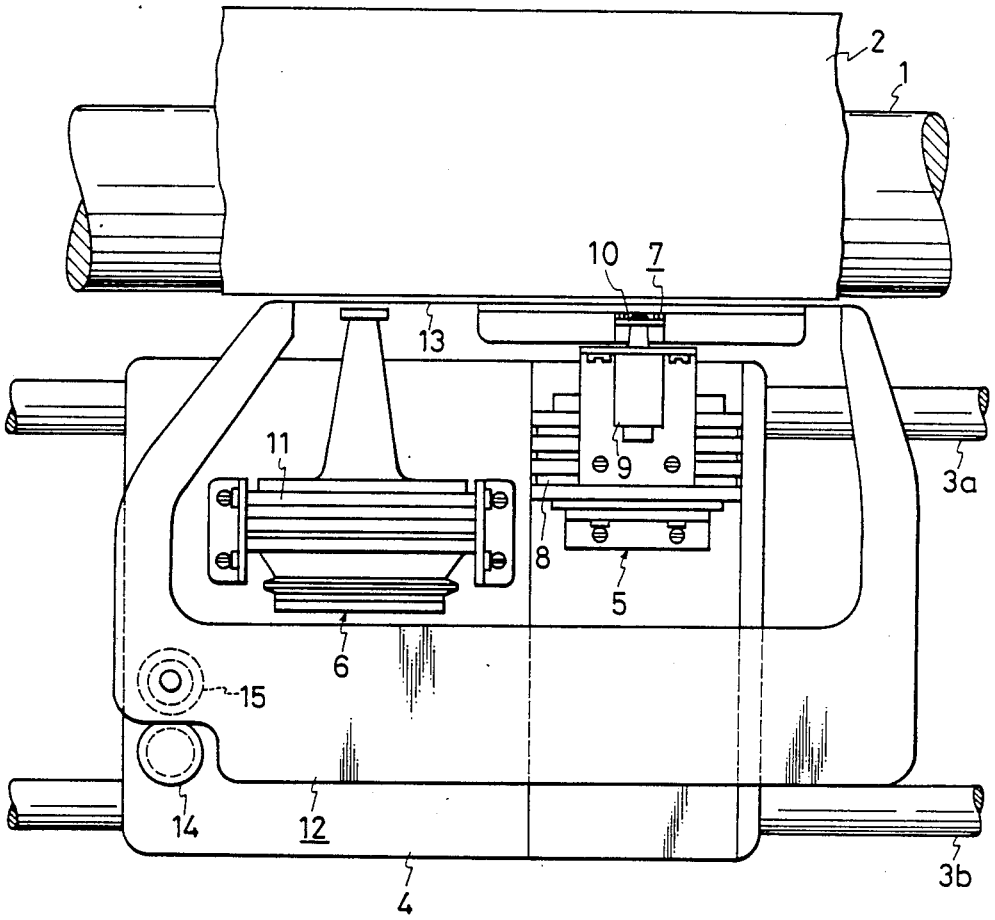
FIG. 1 is a schematic top view illustrating a printing mechanism of a composite printing apparatus according to the present invention.

As shown in FIG. 1, a platen 1 is rotatably supported by a frame (not shown) of a composite printer. A platen drive motor (not shown) is interlockingly coupled to the platen 1 and the platen 1 is rotated in any given degree arc forward and backward by the platen drive motor to feed a sheet of printing paper 2 set on the surface of the platen 1.

Two guide rods 3*a*, 3*b* are installed across the frame. The guide rods 3*a*, 3*b* extend parallel to the axis of rotation of the platen 1. A carriage 4 is slidably supported on both of the guide rods 3*a*, 3*b* in the axial direction. A carriage drive motor (not shown) is coupled to the carriage 4 through a timing belt (not shown). The carriage 4 is driven to move forward and backward along a line of printing as the carriage drive motor rotates forward and backward, respectively.

A first printing assembly 5 and a second printing assembly 6 are set a fixed distance apart from each other on the carriage 4 in a direction parallel to the line of printing. A print wheel 7 is detachably mounted in the first printing assembly 5. The print wheel 7 may be of the daisy wheel type having 96 type elements 10 on its surface opposite to the platen 1. A type-supporting belt could also be used. The type elements on the print wheel 7 are styled with a font such as pica, elite, or italic, and the type elements are mounted on the wheel 7 so that the relevant characters in the type font may be printed. The first printing assembly 5 is equipped with an indexing motor 8, such as a step motor, for turning the print wheel 7 to place a desired type element in position for printing and a hammer 9 for a striking the back of the selected type elements 10 against the surface of the platen 1 to print corresponding characters on the paper 2.

The second printing assembly 6 includes a wire-dot print head 11 for forming a dot-matrix pattern on the printing paper 2 by means of an electromagnetic device (not shown).

A ribbon cassette 12 is removably mounted on the carriage 4 and includes an inked ribbon 13 that extends past the first printing assembly 5 and the second printing assembly 6. A ribbon feed motor (not shown) is coupled to a support roller 15 through a feed roller 14 and the inked ribbon 13 is driven by the feed motor.

Figure 2:
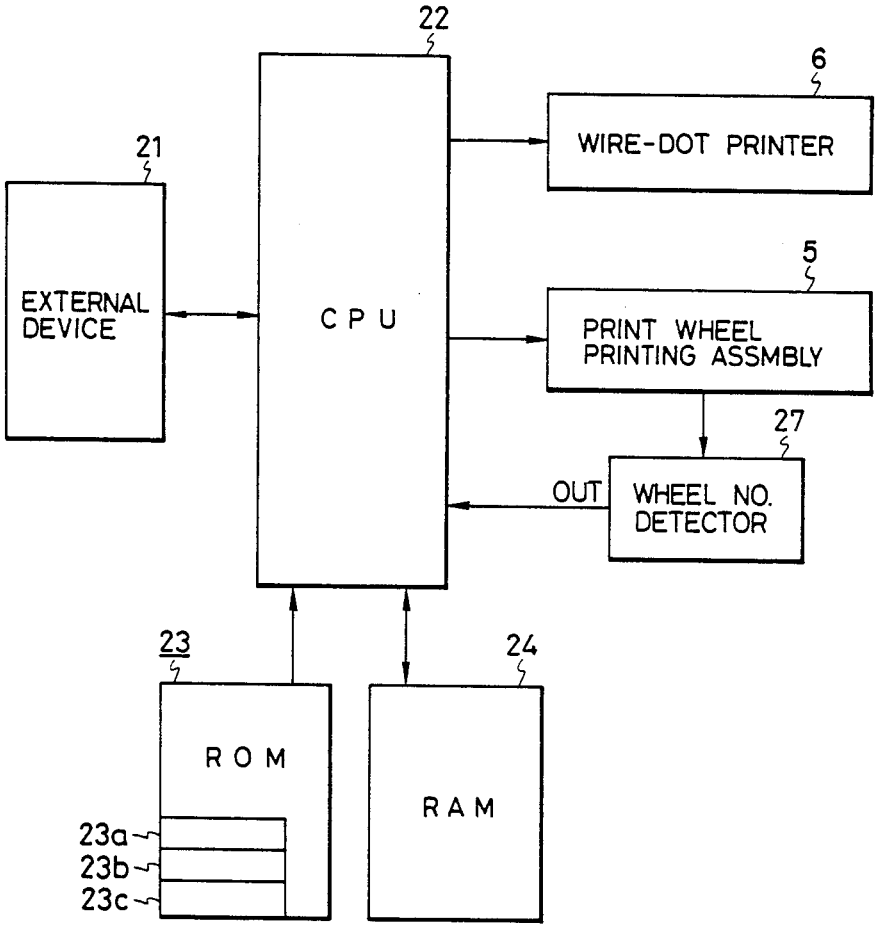
FIG. 2 is a block diagram illustrating further details of an embodiment of the present invention.

In FIG. 2, an external device 21 of a computer issues printing instructions and is connected to a central processing unit (CPU) 22. A read-only memory (ROM) 23 is connected to the CPU 22. The ROM 23 stores data in areas 23*a*, 23*b*, 23*c* concerning an angle of rotation for shifting each type element to the printing position on the print wheel for print wheels containing the characters of the English, Greek, or Hangul alphabets, the proper impact force for each type element, dot matrix printing pattern data for the characters not contained on the print wheel 7, and programs for implementing each process. A random-access memory (RAM) 24 is also connected to the CPU 22 and functions as a work area when each process is implemented.

Figure 3:
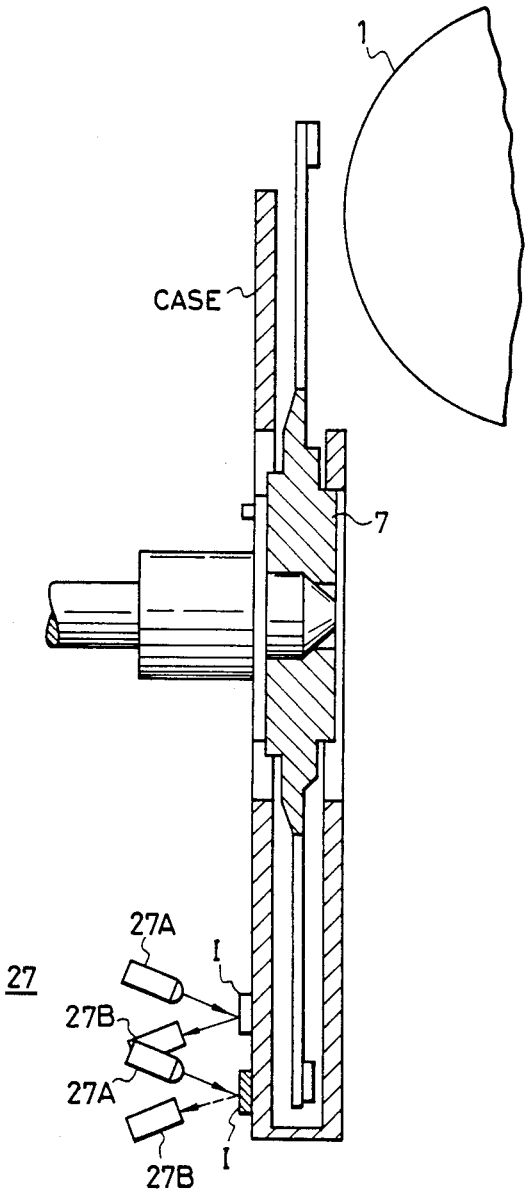
FIG. 3 is a schematic diagram of the wheel number detector shown in FIG. 3.

A wire-dot printing assembly 6 and a print wheel printing assembly 5 are connected to the CPU 22. The wire-dot printing assembly 6 prints characters by using printing wires to abut against the surface of the printing paper according to the printing pattern data 23*a*, 23*b*, and 23*c* stored in the ROM 23. The print wheel printing assembly 5 prints characters by using abuttable font print elements. A wheel number detector 27 is connected to the print wheel printing assembly 5 and the CPU 22 to send to the CPU 22 data identifying the type of print wheel mounted in the print wheel printing assembly 5. The print wheel is contained in a cassette case and the print wheel as contained therein is mounted in the print wheel printing assembly 5. The wheel number detector 27 is so arranged as to optically detect a number associated with the print wheel for example by reflecting light on optical indicia according to the number of the print wheel in the cassette case. There are three kinds of print wheels for the present embodiment and thus numbers 1 through 3 could correspond to the English, Greek, and Hangul alphabets, respectively. FIG. 3 is a schematic illustration of an example of the wheel number detector 27 of FIG. 2. The print wheel 7 is the one such as disclosed in U.S. Pat. No. 4,389,129. A pair of optical indicia I are provided on one surface of the case of the print wheel 7 to identify the font of the type elements 10. The wheel number detector 27 includes a pair of light sources 27A focused on the respective optical indicia I. The light pulses are received or not received by a pair of photodetectors 27B and converted into a corresponding font identification signal OUT supplied to the CPU 22.

Figure 4:
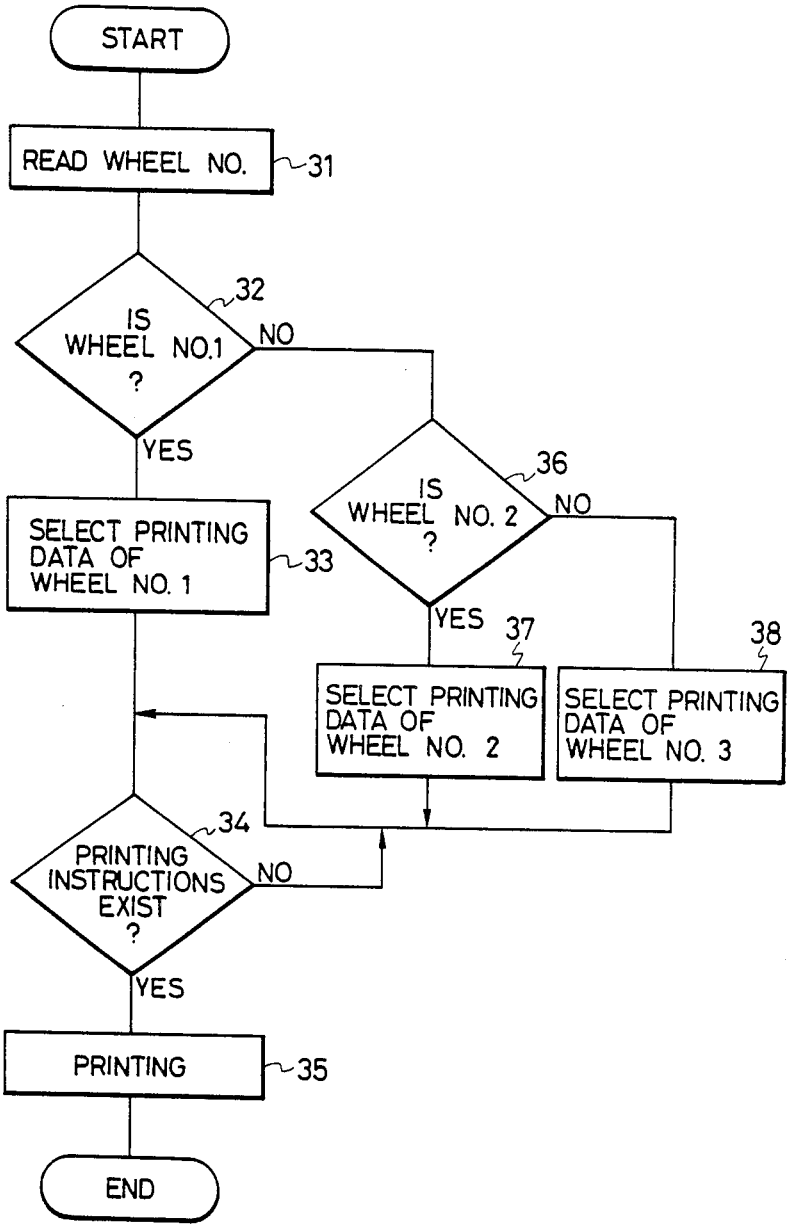
FIG. 4 is a flowchart illustrating the operation of the present invention.

The operation of the printing apparatus of the present invention will be described with reference to FIG. 4. As shown in FIG. 4, the number of the print wheel mounted in the print wheel printing assembly 5 is first detected by the wheel number detector 27 in step 31 when power is supplied to the printing apparatus and a print wheel is mounted therein. Subsequently, a decision is made in step 32 regarding whether or not the wheel number detected in step 31 is 1. When the print wheel number is 1, step 33 is performed wherein the data 23*a* regarding the wheel number 1 including an angle of rotation of type wheel for selecting a desired type element, impact data as to impact force of the hammer, and printing pattern data corresponding to the wheel number 1 are selected from the ROM 23. The printing patterns prepared to supplement each print wheel 7 are arranged to provide uniform print images even when the printing patterns are printed by the wire-dot printer assembly in the same line of characters printed by the print wheel printing assembly 5. Accordingly, a set of printing patterns is provided for each print wheel and includes printing data such as an angle of rotation and impact force. For instance, if the print wheel presently mounted includes an English font when the wheel number detected in step 31 is 1, the printing data 23*a* containing the English alphabetic font is selected.

In step 34, a decision is made as to whether or not printing instructions have been given by the external device 21 and a stand-by condition is maintained until such instructions are received. Step 35 is performed when the printing instructions have already been received and, according to the instructions, the print wheel printing assembly 5 or the wire-dot printing assembly 6 is used to print characters.

On the contrary, if the wheel number is not 1, step 36 will be performed wherein it is determined whether or not the wheel number is 2. When the number is 2, step 37 is performed wherein printing data 23b corresponding to print wheel number 2 is selected and step 34 is performed. If the wheel number is not determined to be 2 in step 36, step 38 is performed wherein printing data 23*c* corresponding to print wheel number 3 is selected and step 34 is then performed.

Although the wheel number detector 27 is designed to detect the wheel number automatically in this embodiment, it is also possible to use a switch to be changed manually by the operator in conformity with the type of print wheel presently mounted.

Moreover, a plurality of print wheels may be prepared for the same language to cover various type fonts, for instance, script and block letters in English and printing pitches such as pica, elite, and micron. In that case, a plurality of printing patterns corresponding to the number of different types of print wheels can be easily prepared and stored in the ROM 23 to implement the aforementioned printing operations.

As set forth above, the printing apparatus according to the present invention is capable of forming characters with uniform print quality and images despite the joint use of fonts and printing patterns. Moreover, a plurality of printing patterns are stored in a pattern memory in accordance with the number of possible combinations of fonts so that an optimum set is selected from the plurality of printing patterns depending on the font of the print wheel selected for use.

The present invention may be embodied with other changes, modifications and improvements which may occur to those skilled in the art, in the light of the foregoing teachings, without departing from the spirit and scope of the invention defined in the appended claims.

What is claimed is:

1. A composite printing apparatus including a first printing assembly having a type element carrier for impact printing with the type elements thereon and a second printing assembly for forming dot images of characters in accordance with character pattern signals supplied to the second printing assembly, the composite printing apparatus comprising:

means for detecting the type of font of the type elements on the type element carrier;

a pattern memory for storing a plurality of sets of character pattern signals; and means responsive to the type of font detected by said detecting means for selectively accessing a set of character pattern signals stored in said pattern memory and for supplying said accessed character pattern signals to said second printing assembly.

2. A composite printing apparatus according to claim 1, wherein said type element carrier comprises a type wheel.

3. A composite printing apparatus according to claim 1, wherein the type element carrier has identifying indicia thereon and wherein said detecting means comprises a light source for illuminating said indicia and an optical detector for receiving light reflected from said indicia and for generating therefrom an output signal corresponding to the identifying indicia.

4. A composite printing apparatus according to claim 3, wherein the type element carrier comprises a type wheel and a case for installing the type wheel, and said indicia is provided on one surface of the case.

5. A composite printing apparatus according to claim 1, wherein the second printing assembly is a wire dot printer.

6. A composite printing apparatus assembly comprising:

a first printing assembly including a type element carrier having type elements thereon adapted for forming character images by impact printing, said carrier having indicia thereon for identifying characteristics of said type elements;

a second printing assembly adapted for producing dot matrix printing of images of characters in accordance with character pattern signals;

means for generating a print character signal from said indicia on said carrier, said print character signal from identifying the characteristics of said type elements;

a pattern memory for storing a plurality of sets of character pattern signals; and means responsive to said print character signal for accessing from said pattern memory a set of character pattern signals corresponding to the characteristics of said type elements such that said character images formed by said second printing assembly correspond in characteristics to said character images formed by impact printing by said first printing assembly.

* * * * *